US005987097A

United States Patent [19]

Salasoo

[11] Patent Number: 5,987,097

[45] Date of Patent: Nov. 16, 1999

[54] X-RAY TUBE HAVING REDUCED WINDOW HEATING

[75] Inventor: Lembit Salasoo, Niskayuna, N.Y.

[73] Assignee: General Electric Company, Schenectady, N.Y.

[21] Appl. No.: 08/996,713

[22] Filed: Dec. 23, 1997

[51] Int. Cl.[6] ..... H01J 35/10

[52] U.S. Cl. ..... 378/141; 378/137; 378/138

[58] Field of Search ..... 378/141, 121, 378/127, 130, 137, 199, 200

[56] References Cited

U.S. PATENT DOCUMENTS

| | | | |
|---|---|---|---|
| 4,344,013 | 8/1982 | Ledley | 313/60 |
| 5,206,895 | 4/1993 | Danos | 378/121 |
| 5,222,118 | 6/1993 | Gerth | 378/200 |
| 5,511,104 | 4/1996 | Mueller et al. | 378/125 |
| 5,652,778 | 7/1997 | Tekriwal | 378/132 |
| 5,673,301 | 9/1997 | Tekriwal | 378/130 |

*Primary Examiner*—David P. Porta
*Assistant Examiner*—Michael J. Schwartz
*Attorney, Agent, or Firm*—Douglas E. Erickson; Marvin Snyder

[57] ABSTRACT

An X-ray tube assembly having a cathode, an anode, and an electrode surrounded by a vacuum-enclosing frame. Electrons from the cathode strike a target surface on the anode. Some electrons produce X-rays which exit an X-ray transparent window portion of the frame. Other electrons are backscattered and go on to strike and heat the frame including the window region. The non-electron-emifting electrode typically has a negative electrical potential and is positioned to deflect the backscattered electrons away from the window region which reduces heating thereto and hence minimizes tube failure.

13 Claims, 1 Drawing Sheet

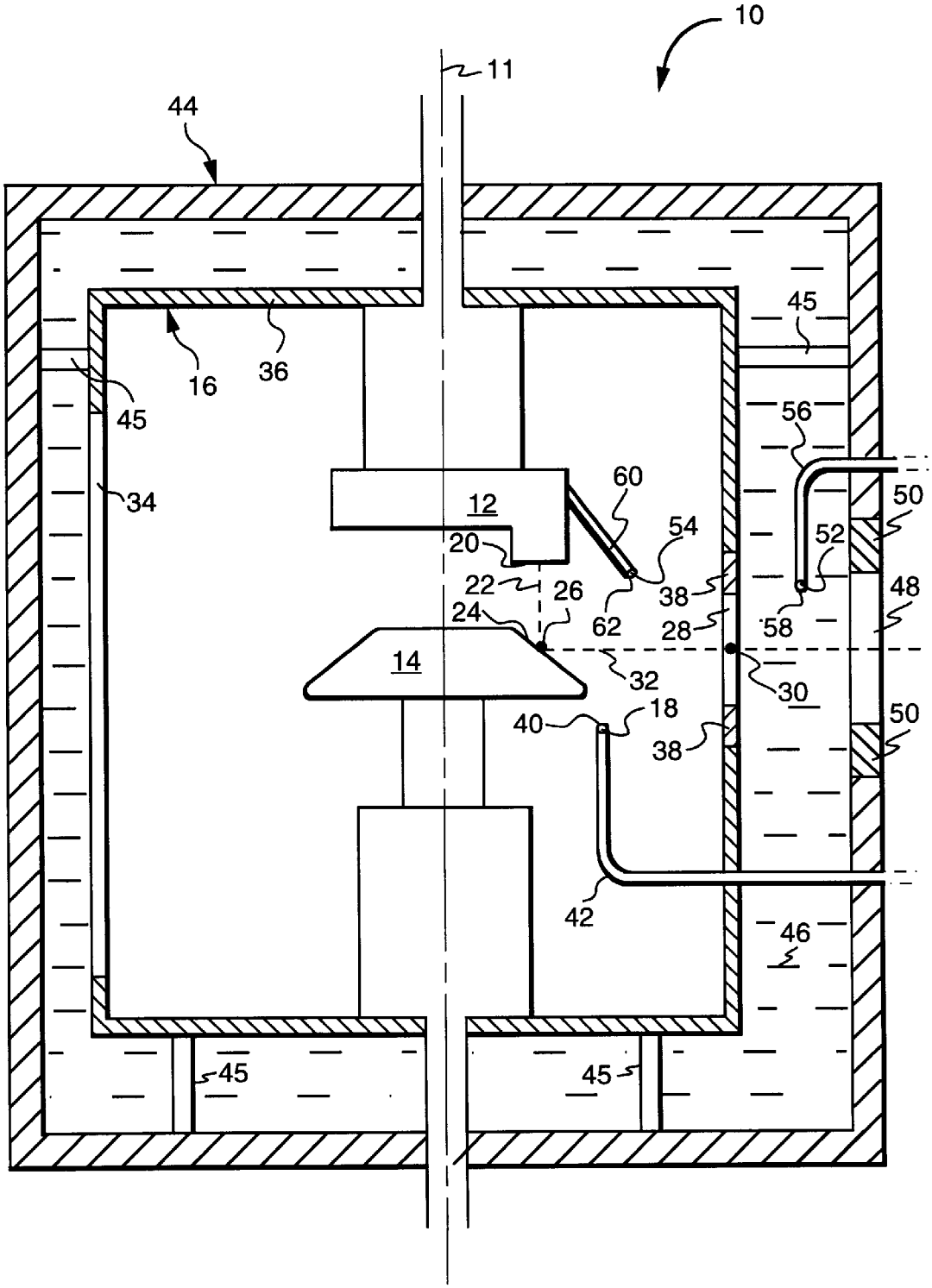
10
11
44
45
16
36
45
56
34
60
12
50
54
52
20
22
26
38
48
24
62
28
58
14
32
30
18
40
50
38
42
46
45
45

X-RAY TUBE HAVING REDUCED WINDOW HEATING

FIELD OF THE INVENTION

The present invention relates generally to X-ray tubes, and more particularly to an X-ray tube which includes a frame having an X-ray transparent window and a window mount which both experience heating.

BACKGROUND OF THE INVENTION

X-ray devices used in the medical field contain an X-ray tube which typically includes a cathode which is heated to emit electrons, a (typically rotating) anode having a target surface facing the cathode, and a surrounding glass and/or metal frame containing an X-ray-transparent window secured by a window mount. Some emitted electrons strike the target surface and produce X-rays, and some of the X-rays exit the frame as an X-ray beam through the X-ray-transparent window. Other emitted electrons do not produce X-rays and are backscattered when they strike the target surface. Many of the backscattered electrons go on to strike and heat the frame including the X-ray-transparent window and the window mount. The frame is also heated from within by other sources such as thermal radiation. The heated frame is typically cooled by a liquid coolant, such as oil or water, located between the frame and a surrounding casing.

The heating of the frame is uneven and often has a peak in the region of the X-ray-transparent window due to the backscattered electrons concentrated there. The dissimilar coefficients of thermal expansion of the X-ray-transparent window and the window mount generate mechanical stresses which can cause tube failure. Additionally, high temperatures in the X-ray-transparent window itself can induce boiling of the adjoining liquid coolant. Such coolant boiling will degrade the quality of the X-ray beam which exits the frame through the X-ray-transparent window. Existing grounded metal frame tubes include those having high-cost components to mechanically join the window to the rest of the frame while reducing thermal stresses to acceptable levels. Some known tubes have enhanced cooling applied to the window region.

What is needed is an improved X-ray tube design which reduces heating of the X-ray-transparent window and the window mount.

SUMMARY OF THE INVENTION

In a first broad description, the X-ray tube assembly of the invention has an X-ray tube cathode, an X-ray tube anode, a generally-hermetically-sealed frame, and a generally-non-electron-emitting electrode. The cathode has a first electrical potential and includes an electron emitting surface having an electron beam axis. The anode is spaced apart from the cathode, has a second electrical potential which is more positive than the first electrical potential, and includes an X-ray target surface generally facing the electron emitting surface of the cathode and intersecting the electron beam axis at a focal point. The frame surrounds the cathode and the anode, is spaced apart from the electron emitting surface and the X-ray target surface, and includes an essentially-X-ray-transparent window having a perimeter and a point center of mass. The focal point and the point center of mass define an X-ray beam centerline. The electrode is located within the frame, is spaced apart from the electron emitting surface and the X-ray target surface and the window, and has a third electrical potential which is more negative than the second electrical potential. Preferably, the electrode has at least a portion whose projection onto the X-ray beam centerline falls between the focal point and the point center of mass. It is preferred that the frame also include a window mount securing the x-ray-transparent window, wherein the distance from a farthest point on the window mount to the X-ray beam centerline is greater than the distance from the portion of the electrode to the X-ray beam centerline.

In a second broad description, the X-ray tube assembly of the invention has an X-ray tube cathode, an X-ray tube anode, and a generally-hermetically-sealed glass frame, a casing, a dielectric liquid coolant, and a generally-non-electron-emiffing electrode. The cathode has a first electrical potential and includes an electron emitting surface having an electron beam axis. The anode is spaced apart from the cathode, has a second electrical potential which is more positive than the first electrical potential, and includes an X-ray target surface generally facing the electron emitting surface of the cathode and intersecting the electron beam axis at a focal point. The frame surrounds the cathode and the anode, is spaced apart from the electron emitting surface and the X-ray target surface, and includes an essentially-X-ray-transparent window having a perimeter and a point center of mass. The focal point and the point center of mass define an X-ray beam centerline. The casing surrounds and is generally spaced apart from the frame. The coolant is located between the frame and the casing. The electrode is located between the frame and the casing, has a third electrical potential which is more negative than the second electrical potential, and includes at least a portion having a projection onto the X-ray beam centerline. Preferably, the point center of mass is located between the focal point and the projection.

Several benefits and advantages are derived from the invention. The non-electron-emitting electrode to electrostatically deflect backscattered electrons away from the X-ray-transparent window and the window mount which reduces heating thereof. Such reduced heating reduces differential thermal expansion of the X-ray-transparent window and the window mount which reduces mechanical stresses and the possibility of tube failure. Such reduced heating also reduces coolant boiling which improves the quality of the X-ray beam exiting the X-ray-transparent window.

DESCRIPTION OF THE DRAWINGS

The FIGURE is a schematic cross-sectional view of an exemplary construction of the X-ray tube assembly of the present invention.

DETAILED DESCRIPTION OF THE INVENTION

Referring now to the drawings, the Figure schematically shows an exemplary construction of the X-ray tube assembly 10 of the present invention. In a first broad description of the X-ray tube assembly 10, the X-ray tube assembly 10 has a tube axis 11 and includes an X-ray tube cathode 12, an X-ray tube anode 14, a generally-hermetically-sealed frame 16, and generally-non-electron-emitting-electrode 18. The cathode 12 has a first electrical potential and includes an electron emitting surface 20 having an electron beam axis 22. Preferably, the cathode 12 has a negative voltage of preferably between generally minus thirty kilovolts and generally minus eighty kilovolts.

The anode 14 is spaced apart from the cathode 12 and has a second electrical potential which is more positive than the first electrical potential. Preferably, the anode 14 has a positive voltage of preferably between generally plus thirty kilovolts and generally plus eighty kilovolts. The anode 14 includes an X-ray target surface 24 which generally faces the electron emitting surface 20 of the cathode 12 and which intersects the electron beam axis 22 at a focal point 26.

The frame 16, which acts as a vacuum enclosure, surrounds the cathode 12 and the anode 14 and is spaced apart from the electron emitting surface 20 of the cathode 12 and the X-ray target surface 24 of the anode 14. The frame 16 includes an essentially-X-ray-transparent window 28 which has a perimeter and a point center of mass 30. The focal point 26 and the point center of mass 30 define an X-ray beam centerline 32. The choice of material for the frame 16 is left to the artisan. For example, and without limitation, the frame 16 may consist essentially of glass or may consist essentially of metal. The frame 16 may also have a glass section 34 and a metal section 36 as shown in the Figure. The X-ray-transparent window 28 may, without limitation, comprise, or consist essentially of, glass or metal as is known to those skilled in the art. For a metal frame, a preferred bulk frame material is copper or steel, and for the X-ray-transparent window portion, a preferred material is beryllium. The frame 16 also includes a window mount 38 securing the X-ray-transparent window 28. The window mount 38 likewise may, without limitation, comprise, or consist essentially of, glass or metal as is known to those skilled in the art. It s noted that a glass window mount is an area of the frame which transitions from the glass used for the non-window portion of the frame.

The electrode 18 is disposed within the frame 16 and is spaced apart from the electron emitting surface 20 and the X-ray target surface 24 and the X-ray-transparent window 28. The electrode 18 has a third electrical potential which is more negative than the second electrical potential of the anode 14. Preferably, the electrode 18 has a negative electrical potential. The electrode 18 preferably has at least a portion 40 whose projection onto the X-ray beam centerline 32 falls between the focal point 26 and the point center of mass 30. The electrode 18 is mechanically unsupported by the cathode 12. Preferably, the third electrical potential of the electrode 18 is different from the first electrical potential of the cathode 12. The electrode 18 is mechanically supported by an arm 42 which also contains, or acts as, an electrical lead. The arm 42 is attached to the frame 16. Such attachment is a dielectric attachment when the frame 16 is a metal frame.

Exemplary locations for the electrode 18 include those which satisfy one or more of the following positional criteria. Preferably, the distance from the projection, of the portion 40 of the electrode 18 onto the X-ray beam centerline 32, to the focal point 26 is less than the distance from such projection to the X-ray-transparent window 28 since early deflection of backscattered electrons by the electrode 18 will better protect the X-ray-transparent window 28 and the window mount 38. Preferably, the distance from the portion 40 of the electrode 18 to the X-ray beam centerline 32 is greater than the distance from any point on the perimeter of the X-ray-transparent window 28 to the X-ray beam centerline 32. This places the portion 40 of the electrode 18 out of any line of sight from the focal point 26 to any point on the X-ray-transparent window 28 so as not to degrade the quality of the X-ray beam exiting the X-ray-transparent window 28. Preferably, the distance from a furthest point on the window mount 38 to the X-ray beam centerline 32 is greater than the distance from the portion 40 of the electrode 18 to the X-ray beam centerline 32. There is no need for the portion 40 of the electrode 18 to extend beyond the window mount 38 since the area of the frame 16 critical to heating is limited to the X-ray-transparent window 28 and the window mount 38. Preferably, the distance between the electron emitting surface 20 of the cathode 12 and the focal point 26 is greater than the distance between the portion 40 of the electrode 18 and the X-ray beam centerline 32. This provides for early deflection of backscattered electrons by the electrode 18 which will better protect the X-ray-transparent window 28 and the window mount 38.

In an exemplary construction, the X-ray tube assembly 10 moreover includes a casing 44 which surrounds and is generally spaced apart from the frame 16 by dielectric spacers 45. A liquid coolant 46, such as oil or water, is disposed between the frame 16 and the casing 44. The casing 44 includes an essentially-X-ray-transparent window 48 and a window mount 50. The casing 44 typically is an X-ray-shielding metal casing except for its X-ray transparent window 48. Two additional electrodes 52 and 54, which are shown in the Figure, are not present in the first broad description. It is noted that additional electrodes generally identical to electrode 18 may be required for a particular X-ray tube application. It is noted that electrode 18 must be spaced apart a sufficient distance from any additional such electrodes if of a different electrical potential, from the anode 14, and from the cathode 12 if of a different electrical potential, to keep tube sparking in operation to an acceptably low value. In addition, electrode 18, and any additional such electrodes, should have smooth surfaces and not have any sharp points or edges that would enhance the surface field and facilitate electrical breakdown.

A second broad description of the X-ray tube assembly 10 of the present invention is identical to the previously-described first broad description but with electrode 18 and arm 42 removed and replaced with electrode 52 and arm 56, with the frame 16 being a glass frame, and with the liquid coolant 46 being a dielectric liquid coolant, such as oil. Electrode 52 is a generally-non-electron-emitting electrode disposed between the frame 16 and the casing 44. Electrode 52 has a third electrical potential which is more negative than the second electrical potential of the anode 14. Electrode 52 includes at least a portion 58 having a projection onto the X-ray beam centerline 32, and preferably the point center of mass 30 is disposed between the focal point 26 and the projection of portion 58 onto the X-ray beam centerline 32. The electrode 52 is mechanically supported by arm 56 which also contains, or acts as, an electrical lead. The arm 56 is attached to the casing 44. Such attachment is a dielectric attachment when the casing 44 is a metal casing. The two other electrodes 18 and 54, which are shown in the Figure, are not present in the second broad description. It is noted that additional electrodes generally identical to electrode 18 may be required for a particular X-ray tube application.

A third broad description of the X-ray assembly 10 of the present invention is identical to the previously-described first broad description but with electrode 18 and arm 42 removed and replaced with electrode 54 and arm 60. Electrode 54 is electrically connected and mechanically attached to the cathode 12 by arm 60. It is noted that portion 62 of electrode 54 has the same preferred positional criteria as portion 40 of electrode 18. The two other electrodes 18 and 52, which are shown in the Figure, are not present in the third broad description. It is noted that additional electrodes generally identical to electrode 54 may be required for a particular X-ray tube application. It is further noted that all three broad description provide an X-ray tube assembly 10 which reduces the deposition of backscattered electron energy, and therefore reduces heating, to the X-ray-transparent window 28 and the window mount 38 of the frame 16 by deflecting or repelling the backscattered electrons and forcing them either to return to the anode 14 or to hit the frame 16 away from the region of the X-ray-transparent window 28 and the window mount 38.

In a preferred design, electrode 54 is made of a two millimeter diameter tube which gives an acceptably low surface electric field. Electrode 54 is curved, in a circular arc about the tube axis 11, to maintain a constant clearance from the frame 16 and the anode 14. The arc subtends sixty degrees so as to provide protection for the complete width of the X-ray-transparent window 28 of the frame 16. Preferably, the window 28 is aligned with the rest of the adjoining wall of the frame 16 (as shown in the Figure), but a particular application may require that the window 28 protrude outward from, or be recessed inward from, the adjoining wall of the frame 16. Electrode 54 is supported from the cathode 12 by a system of three lightweight struts (only one of which, arm 60, is shown in the Figure) to give sufficient rigidity without unduly increasing the weight of the cathode 12. The struts closest to the anode 14 should not present any edges with undue electric field enhancement towards the anode 14. This is achieved by using the same two millimeter diameter tube as used by the electrode 54 itself. The angle bend from the strut to the electrode 54 should be rounded to one millimeter radius or higher, to avoid undesirable local field enhancement. Engineering analysis indicates that this design should reduce the peak density of backscattered electron heat deposition to the X-ray-transparent window 28 by generally thirty-nine percent and should reduce the total backscattered electron heat deposition to the frame 16 by generally forty-seven percent. It is noted that the third broad description provides a design in which no backscattered electrons have sufficient energy to hit the cathode 12. Hence, there will be no backscattered electron heat flux to the electrode 54. In addition, the electrode 54 does not require an extra voltage feedthrough into the tube vacuum (i.e., into the vacuum-enclosing frame 16).

The foregoing descriptions of an exemplary construction of the invention have been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. An X-ray tube assembly comprising:

a) an X-ray tube cathode having a first electrical potential and including an electron emitting surface having an electron beam axis;

b) an X-ray tube anode spaced apart from said cathode, having a second electrical potential which is more positive than said first electrical potential, and including an X-ray target surface generally facing said electron emitting surface of said cathode and intersecting said electron beam axis at a focal point;

c) a generally-hermetically-sealed frame surrounding said cathode and said anode, spaced apart from said electron emitting surface and said X-ray target surface, and including an essentially-X-ray-transparent window having a perimeter and a point center of mass, wherein said focal point and said point center of mass define an X-ray beam centerline; and d) a generally-non-electron-emitting electrode disposed within said frame, spaced apart from said electron emitting surface and said X-ray target surface and said window, and having a third electrical potential which is more negative than said second electrical potential, wherein said X-ray tube assembly is devoid of any electrode disposed within said frame, other than said anode, which attracts electrons.

2. The X-ray tube assembly of claim 1, also including a casing which surrounds and is generally spaced apart from said frame, and further including a liquid coolant disposed between said frame and said casing.

3. The X-ray tube assembly of claim 1, wherein said electrode is electrically connected and mechanically attached to said cathode.

4. The X-ray tube assembly of claim 1, wherein said third electrical potential of said electrode is different from said first electrical potential of said cathode, and wherein said electrode is mechanically unsupported by said cathode.

5. The X-ray tube assembly of claim 1, wherein said frame comprises glass.

6. The X-ray tube assembly of claim 1, wherein said frame comprises metal.

7. The X-ray tube assembly of claim 1, wherein said electrode has at least a portion whose projection onto said X-ray beam centerline falls between said focal point and said point center of mass.

8. The X-ray tube assembly of claim 7, wherein the distance from said projection to said focal point is less than the distance from said projection to said window.

9. The X-ray tube assembly of claim 7, wherein the distance from said portion of said electrode to said X-ray beam centerline is greater than the distance from any point on said perimeter of said window to said X-ray beam centerline.

10. The X-ray tube assembly of claim 7, wherein said frame also includes a window mount securing said window, and wherein the distance from a furthest point on said window mount to said X-ray beam centerline is greater than the distance from said portion of said electrode to said X-ray beam centerline.

11. The X-ray tube assembly of claim 7, wherein the distance between said electron emitting surface and said focal point is greater than the distance between said portion of said electrode and said X-ray beam centerline.

12. An X-ray tube assembly comprising:

a) an X-ray tube cathode having a first electrical potential and including an electron emitting surface having an electron beam axis;

b) an X-ray tube anode spaced apart from said cathode, having a second electrical potential which is more positive than said first electrical potential, and including an X-ray target surface generally facing said electron emitting surface of said cathode and intersecting said electron beam axis at a focal point;

c) a generally-hermetically-sealed glass frame surrounding said cathode and said anode, spaced apart from said electron emitting surface and said X-ray target surface, and including an essentially-X-ray-transparent window having a perimeter and a point center of mass, wherein said focal point and said point center of mass define an X-ray beam centerline;

d) a casing surrounding and generally spaced apart from said frame;

e) a dielectric liquid coolant disposed between said frame and said casing; and f) a generally-non-electron-emitting electrode disposed between said frame and said casing, and having a third electrical potential which is more negative than said second electrical potential, wherein said X-ray tube assembly is devoid of any electrode disposed between said frame and said casing which attracts electrons.

13. The X-ray tube assembly of claim 12, wherein said electrode includes at least a portion having a projection onto said X-ray beam centerline, and wherein said point center of mass is disposed between said focal point and said projection.

* * * * *